US008715003B2

(12) United States Patent
Buck et al.

(10) Patent No.: US 8,715,003 B2
(45) Date of Patent: May 6, 2014

(54) ELECTRICAL CONNECTOR HAVING IMPEDANCE TUNING RIBS

(75) Inventors: Jonathan E. Buck, Hershey, PA (US); Stefaan Hendrik Jozef Sercu, Wuustwezel (BE); Jan De Geest, Wetteren (BE)

(73) Assignees: FCI Americas Technology LLC, Carson City, NV (US); FCI, Guyancourt (FR)

( * ) Notice: Subject to any disclaimer, the term of this patent is extended or adjusted under 35 U.S.C. 154(b) by 283 days.

(21) Appl. No.: 12/974,132

(22) Filed: Dec. 21, 2010

(65) Prior Publication Data

US 2011/0159744 A1 Jun. 30, 2011

Related U.S. Application Data

(60) Provisional application No. 61/291,136, filed on Dec. 30, 2009.

(51) Int. Cl.
*H01R 13/648* (2006.01)

(52) U.S. Cl.
USPC ..... 439/607.07; 439/941

(58) Field of Classification Search
USPC ..... 439/607.07, 607.05, 607.06, 941
See application file for complete search history.

(56) References Cited

U.S. PATENT DOCUMENTS

| | | | |
|---|---|---|---|
| 3,286,220 | A | 11/1966 | Marley et al. |
| 3,390,369 | A | 6/1968 | Zavertnik et al. |
| 3,538,486 | A | 11/1970 | Shlesinger, Jr. |
| 3,587,028 | A | 6/1971 | Uberbacher |
| 3,669,054 | A | 6/1972 | Desso et al. |
| 3,748,633 | A | 7/1973 | Lundergan |
| 4,003,840 | A | 1/1977 | Ishino et al. |
| 4,045,105 | A | 8/1977 | Lee et al. |
| 4,076,362 | A | 2/1978 | Ichimura |
| 4,159,861 | A | 7/1979 | Anhalt |
| 4,260,212 | A | 4/1981 | Ritchie et al. |
| 4,288,139 | A | 9/1981 | Cobaugh et al. |
| 4,383,724 | A | 5/1983 | Verhoeven |

(Continued)

FOREIGN PATENT DOCUMENTS

| | | |
|---|---|---|
| EP | 0273683 | 7/1988 |
| EP | 0891016 | 10/2002 |

(Continued)

OTHER PUBLICATIONS

International Search Report/Written Opinion for PCT/US2010/061477 filed Dec. 21, 2010; Mailing Date of ISR/Written Opinion: Sep. 27, 2011.

(Continued)

*Primary Examiner* — Neil Abrams
(74) *Attorney, Agent, or Firm* — Baker & Hostetler LLP

(57) ABSTRACT

An electrical connector is provided that includes a connector housing supporting a plurality of electrical contacts. The electrical contacts are edge-coupled along a column direction, and spaced apart along a row direction so as to define a space that is defined by adjacent electrical contacts along the row direction. The electrical connector includes at least one rib disposed in the space. The rib has a dielectric constant greater than air such that the dielectric constant of the space is increased with respect to a substantially identical space that is filled only with air. The increased dielectric constant reduces the impedance of the electrical connector.

34 Claims, 10 Drawing Sheets

(56) References Cited

U.S. PATENT DOCUMENTS 4,402,563 A 9/1983 Sinclair
4,482,937 A 11/1984 Berg
4,560,222 A 12/1985 Dambach
4,717,360 A 1/1988 Czaja
4,734,060 A 3/1988 Kawawada et al.
4,776,803 A 10/1988 Pretchel et al.
4,815,987 A 3/1989 Kawano et al.
4,867,713 A 9/1989 Ozu et al.
4,907,990 A 3/1990 Bertho et al.
4,913,664 A 4/1990 Dixon et al.
4,973,271 A 11/1990 Ishizuka et al.
4,997,376 A * 3/1991 Buck et al. ..... 439/59
5,066,236 A 11/1991 Broeksteeg
5,077,893 A 1/1992 Mosquera et al.
5,098,311 A 3/1992 Roath et al.
5,163,849 A 11/1992 Fogg et al.
5,167,528 A 12/1992 Nishiyama et al.
5,169,324 A 12/1992 Lemke et al.
5,174,770 A 12/1992 Sasaki et al.
5,192,231 A 3/1993 Dolin, Jr.
5,224,867 A 7/1993 Ohtsuki et al.
5,238,414 A 8/1993 Yaegashi et al.
5,254,012 A 10/1993 Wang
5,274,918 A 1/1994 Reed
5,277,624 A 1/1994 Champion et al.
5,286,212 A 2/1994 Broeksteeg
5,302,135 A 4/1994 Lee
5,334,955 A 8/1994 Strnad
5,342,211 A 8/1994 Broeksteeg
5,356,300 A 10/1994 Costello et al.
5,356,301 A 10/1994 Champion et al.
5,357,050 A 10/1994 Baran et al.
5,431,578 A 7/1995 Wayne
5,475,922 A 12/1995 Tamura et al.
5,525,067 A 6/1996 Gatti
5,558,542 A 9/1996 O'Sullivan et al.
5,586,914 A 12/1996 Foster, Jr. et al.
5,590,463 A 1/1997 Feldman et al.
5,609,502 A 3/1997 Thumma
5,641,141 A 6/1997 Goodwin
5,713,746 A 2/1998 Olson et al.
5,730,609 A 3/1998 Harwath
5,741,144 A 4/1998 Elco et al.
5,741,161 A 4/1998 Cahaly et al.
5,795,191 A * 8/1998 Preputnick et al. ..... 439/607.11
5,817,973 A 10/1998 Elco
5,853,797 A 12/1998 Fuchs et al.
5,908,333 A 6/1999 Perino et al.
5,925,274 A 7/1999 McKinney et al.
5,961,355 A 10/1999 Morlion et al.
5,967,844 A 10/1999 Doutrich et al.
5,971,817 A 10/1999 Longueville
5,980,321 A 11/1999 Cohen et al.
5,993,259 A 11/1999 Stokoe et al.
6,042,389 A 3/2000 Lemke et al.
6,050,862 A 4/2000 Ishii
6,068,520 A 5/2000 Winings et al.
6,099,332 A 8/2000 Troyan
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,203 A 11/2000 Elco et al.
6,150,729 A 11/2000 Ghahghahi
6,171,115 B1 1/2001 Mickievicz et al.
6,171,149 B1 1/2001 Van Zanten
6,190,213 B1 2/2001 Reichart et al.
6,212,755 B1 4/2001 Shimada et al.
6,219,913 B1 4/2001 Uchiyama
6,220,896 B1 4/2001 Bertoncini et al.
6,227,882 B1 5/2001 Ortega et al.
6,231,391 B1 * 5/2001 Ramey et al. ..... 439/607.07
6,252,163 B1 6/2001 Fujimori et al.
6,267,604 B1 7/2001 Mickievicz et al.
6,269,539 B1 8/2001 Takahashi et al.
6,280,209 B1 8/2001 Bassler et al.
6,293,827 B1 9/2001 Stokoe
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,368,121 B1 4/2002 Ueno et al.
6,371,773 B1 4/2002 Crofoot et al.
6,371,813 B2 * 4/2002 Ramey et al. ..... 439/607.05
6,375,478 B1 4/2002 Kikuchi
6,379,188 B1 4/2002 Cohen et al.
6,386,914 B1 5/2002 Collins et al.
6,409,543 B1 6/2002 Astbury, Jr. et al.
6,431,914 B1 8/2002 Billman
6,435,913 B1 8/2002 Billman
6,435,914 B1 8/2002 Billman
6,461,202 B2 10/2002 Kline
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,081 B2 1/2003 Blanchfield et al.
6,517,360 B1 * 2/2003 Cohen ..... 439/65
6,520,803 B1 2/2003 Dunn
6,527,587 B1 3/2003 Ortega et al.
6,537,111 B2 3/2003 Brammer et al.
6,540,559 B1 4/2003 Kemmick et al.
6,547,066 B2 4/2003 Koch
6,547,606 B1 4/2003 Johnston et al.
6,554,647 B1 4/2003 Cohen et al.
6,572,410 B1 6/2003 Volstorf et al.
6,602,095 B2 8/2003 Astbury, Jr. et al.
6,609,933 B2 8/2003 Yamasaki
6,641,141 B2 11/2003 Schroeder
6,652,318 B1 11/2003 Winings et al.
6,652,319 B1 11/2003 Billman
6,672,907 B2 1/2004 Azuma
6,692,272 B2 2/2004 Lemke et al.
6,695,627 B2 2/2004 Ortega et al.
6,700,455 B2 3/2004 Tripathi et al.
6,702,590 B2 3/2004 Zaderej et al.
6,717,825 B2 4/2004 Volstorf
6,762,067 B1 7/2004 Quinones et al.
6,764,341 B2 7/2004 Lappoehn
6,776,649 B2 8/2004 Pape et al.
6,805,278 B1 10/2004 Olson et al.
6,808,399 B2 10/2004 Rothermel et al.
6,824,391 B2 11/2004 Mickievicz et al.
6,843,686 B2 1/2005 Ohnishi et al.
6,848,944 B2 2/2005 Evans
6,851,974 B2 2/2005 Doutrich
6,852,567 B1 2/2005 Lee et al.
6,863,543 B2 3/2005 Lang et al.
6,869,292 B2 3/2005 Johnescu et al.
6,890,214 B2 5/2005 Brown et al.
6,899,548 B2 5/2005 Houtz
6,905,368 B2 6/2005 Mashiyama et al.
6,913,490 B2 7/2005 Whiteman, Jr. et al.
6,918,776 B2 7/2005 Spink, Jr.
6,918,789 B2 7/2005 Lang et al.
6,932,649 B1 8/2005 Rothermel et al.
6,945,796 B2 9/2005 Bassler et al.
6,953,351 B2 10/2005 Fromm et al.
6,969,268 B2 11/2005 Brunker et al.
6,969,280 B2 * 11/2005 Chien et al. ..... 439/607.13
6,976,886 B2 12/2005 Winings et al.
6,979,202 B2 * 12/2005 Benham et al. ..... 439/65

(56) References Cited

U.S. PATENT DOCUMENTS

| | | | | |
|---|---|---|---|---|
| 6,979,226 | B2 | 12/2005 | Otsu et al. | |
| 6,981,883 | B2 | 1/2006 | Raistrick et al. | |
| 6,988,902 | B2 | 1/2006 | Winings et al. | |
| 6,994,569 | B2 | 2/2006 | Minich et al. | |
| 7,057,115 | B2 | 6/2006 | Clink et al. | |
| 7,097,506 | B2 | 8/2006 | Nakada | |
| 7,118,391 | B2 | 10/2006 | Minich et al. | |
| 7,131,870 | B2 | 11/2006 | Whiteman, Jr. et al. | |
| 7,157,250 | B2 | 1/2007 | San Gabriel et al. | |
| 7,163,421 | B1 * | 1/2007 | Cohen et al. | 439/607.02 |
| 7,182,643 | B2 | 2/2007 | Winings et al. | |
| 7,207,807 | B2 | 4/2007 | Fogg | |
| 7,229,318 | B2 | 6/2007 | Winings et al. | |
| 7,320,621 | B2 | 1/2008 | Laurx et al. | |
| 7,347,740 | B2 * | 3/2008 | Minich | 439/736 |
| 7,371,117 | B2 | 5/2008 | Gailus | |
| 7,384,311 | B2 * | 6/2008 | Sharf et al. | 439/607.05 |
| 7,387,535 | B2 * | 6/2008 | Minich | 439/607.05 |
| 7,407,413 | B2 | 8/2008 | Minich | |
| 7,422,484 | B2 | 9/2008 | Cohen et al. | |
| 7,442,054 | B2 | 10/2008 | Lemke et al. | |
| 7,524,209 | B2 | 4/2009 | Hull et al. | |
| 7,588,463 | B2 * | 9/2009 | Yamada et al. | 439/607.05 |
| 7,663,516 | B1 | 2/2010 | Chandra | |
| 7,708,569 | B2 | 5/2010 | Sercu et al. | |
| 7,713,088 | B2 * | 5/2010 | Sercu et al. | 439/607.1 |
| 7,727,017 | B2 * | 6/2010 | Amleshi et al. | 439/607.11 |
| 7,753,731 | B2 | 7/2010 | Cohen et al. | |
| 7,789,676 | B2 * | 9/2010 | Morgan et al. | 439/79 |
| 7,789,705 | B2 * | 9/2010 | Morgan | 439/607.07 |
| 7,794,278 | B2 * | 9/2010 | Cohen et al. | 439/607.09 |
| 7,798,852 | B2 * | 9/2010 | Laurx et al. | 439/607.08 |
| 7,806,729 | B2 * | 10/2010 | Nguyen et al. | 439/607.23 |
| 7,819,697 | B2 * | 10/2010 | Glover et al. | 439/607.07 |
| 7,867,031 | B2 * | 1/2011 | Amleshi et al. | 439/607.08 |
| 7,878,853 | B2 * | 2/2011 | Amleshi et al. | 439/607.08 |
| 7,887,371 | B2 * | 2/2011 | Kenny et al. | 439/620.22 |
| 7,914,304 | B2 * | 3/2011 | Cartier et al. | 439/83 |
| 7,976,318 | B2 * | 7/2011 | Fedder et al. | 439/79 |
| 8,011,957 | B2 * | 9/2011 | Pan | 439/607.05 |
| 8,123,563 | B2 * | 2/2012 | Kenny et al. | 439/620.22 |
| 8,147,254 | B2 * | 4/2012 | Shuey et al. | 439/74 |
| 8,157,591 | B2 * | 4/2012 | Fedder et al. | 439/607.07 |
| 8,182,289 | B2 | 5/2012 | Stokoe et al. | |
| 8,231,415 | B2 * | 7/2012 | Johnescu et al. | 439/701 |
| 8,262,412 | B1 * | 9/2012 | Minnick et al. | 439/607.01 |
| 8,366,485 | B2 * | 2/2013 | Johnescu et al. | 439/607.07 |
| 8,430,691 | B2 * | 4/2013 | Davis | 439/607.09 |
| 8,460,032 | B2 * | 6/2013 | Kirk | 439/607.07 |
| 8,469,745 | B2 * | 6/2013 | Davis et al. | 439/607.07 |
| 2001/0012730 | A1 * | 8/2001 | Ramey et al. | 439/608 |
| 2002/0098727 | A1 | 7/2002 | McNamara et al. | |
| 2002/0142629 | A1 | 10/2002 | Zaderej et al. | |
| 2003/0143894 | A1 | 7/2003 | Kline et al. | |
| 2003/0220021 | A1 | 11/2003 | Whiteman, Jr. et al. | |
| 2004/0121652 | A1 | 6/2004 | Gailus | |
| 2005/0009402 | A1 | 1/2005 | Chien et al. | |
| 2005/0118869 | A1 | 6/2005 | Evans | |
| 2005/0170700 | A1 | 8/2005 | Shuey et al. | |
| 2005/0277221 | A1 | 12/2005 | Mongold et al. | |
| 2006/0014433 | A1 | 1/2006 | Consoli et al. | |
| 2006/0046526 | A1 | 3/2006 | Minich | |
| 2006/0192274 | A1 | 8/2006 | Lee et al. | |
| 2006/0234531 | A1 | 10/2006 | Winings et al. | |
| 2007/0004282 | A1 | 1/2007 | Cohen et al. | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0085618 | A1 * | 4/2008 | Sercu et al. | 439/108 |
| 2008/0194146 | A1 | 8/2008 | Gailus | |
| 2008/0203547 | A1 * | 8/2008 | Minich | 257/669 |
| 2009/0130912 | A1 | 5/2009 | Shuey et al. | |
| 2009/0191756 | A1 | 7/2009 | Hull et al. | |
| 2009/0221165 | A1 | 9/2009 | Buck et al. | |
| 2009/0291593 | A1 | 11/2009 | Atkinson et al. | |
| 2011/0159744 | A1 * | 6/2011 | Buck | 439/660 |
| 2011/0230096 | A1 | 9/2011 | Atkinson et al. | |
| 2012/0214344 | A1 | 8/2012 | Cohen et al. | |
| 2013/0224999 | A1 * | 8/2013 | Jeon | 439/607.03 |

FOREIGN PATENT DOCUMENTS

| | | |
|---|---|---|
| EP | 1148587 | 4/2005 |
| JP | 6236788 | 8/1994 |
| JP | 7114958 | 5/1995 |
| JP | 11185886 | 7/1999 |
| JP | 2000/003743 | 1/2000 |
| JP | 2000/003744 | 1/2000 |
| JP | 2000/003745 | 1/2000 |
| JP | 2000/003746 | 1/2000 |
| WO | WO 90/16093 | 12/1990 |
| WO | WO 01/29931 | 4/2001 |
| WO | WO 01/39332 | 5/2001 |
| WO | WO 02/101882 | 12/2002 |
| WO | WO 2006/031296 | 3/2006 |
| WO | WO 2008/005122 | 1/2008 |
| WO | WO 2008/045269 | 4/2008 |
| WO | WO 2008/106001 | 9/2008 |

OTHER PUBLICATIONS

"4.0 UHD Connector Differential Signal Crosstalk, Reflections", 1998, p. 8-9.

"AMP Z-Dok and Z-Dok and Connectors", Tyco Electronics/AMP, Application Specification #114-13068, Aug. 30, 2005, 17 pages.

"AMP Z-Pack 2mm HM Connector, 2mm Centerline, Eight-Row, Right-Angle Applications", Electrical Performance Report, EPR 889065, Issued Sep. 1998, 59 pages.

"AMP Z-Pack 2mm HM Interconnection System", 1992/994, AMP Incorporated, 6 pages.

"AMP Z-Pack HM-Zd Performance at Gigabit Speeds", Tyco Electronics, Report #20GC014, Rev.B., May 4, 2001, 32 pages.

"B.? Bandwidth and Rise Time Budgets, Module 1-8 Fiber Optic Telecommunications (E-XVI-2a)", http:--cord.org-step_online-st1-8-st18exvi2a.htm, 2006, 1-3.

"Champ Z-Dok Connector System", Tyco Electronics, Jan. 2002, 3 pages.

"FCI's Airmax VS Connector System Honored at DesignCon 2005", http:--www.heilind.com-products-fci-airmax-vs-design.asp, Heilind Electronics, Inc., 2005, 1 page.

"Framatome Connector Specification", May 10, 1999, 1 page.

Fusi et al., "Differential Signal Transmission through Backplanes and Connectors", Electronic Packaging and Production, Mar. 1996, 27-31.

"GbXI-Trac Backplane Connector System", molex.com/cgi-bin, Molex, 2007, 1-3.

"Gig-Array Connector System, Board to Board Connectors", 2005, 4 pages.

"Gig-Array High Speed Mezzanine Connectors 15-40 mm Board to Board", FCI Corporation, Jun. 5, 2006, 1 page.

Goel et al., "AMP Z-Pack Interconnect System", AMP Incorporated, 1990, 9 pages.

"HDM Separable Interface Detail", Molex, Feb. 17, 1993, 3 pages.

"HDM Stacker Signal Integrity", http://www.teradyne.com/prods/tcs/products/connectors/mezzanine/hdm_stacker/signintegrity.html, Amphenol TCS (ATCS), Feb. 2, 2006, 3 pages.

"HDM, HDM Plus Connectors", http:--www.teradyne.com-prods-tcs-products-connectors-backplane-hdm-index.html, Amphenol TCS, 2006, 1 page.

"HDM/HDM Plus, 2mm, Backplane Interconnection System", Teradyne Connection Systems, 1993, 22 pages.

"Honda High-Speed Backplane Connector NSP Series", Honda Connectors, Feb. 7, 2003, 25 pages.

Hult, "FCI's Problem Solving Approach Changes Market, The FCI Electronics AirMax VS", http:--www.connecotrsupplier.com-tech_updates_FCI-Airmax_archive.htm, ConnectorSupplier.com, 2006, 1-4.

"Lucent Technologies' Bell Labs and FCI Demonstrate 25gb-S Data Transmission Over Electrical Backplane Connectors", http:--www.lucent.com-press-0205-050201.bla.html, Lucent Tech Bell Labs, Feb. 1, 2005, 1-4.

(56) References Cited

OTHER PUBLICATIONS

"Metrel 2mm High-Speed Connectors, 1000, 2000, 3000 Series, Electrical Performance Data for Differential Applications", FCI Framatome Group, 2 pages.
"Metral Speed & Density Extensions", FCI, Jun. 3, 1999, 1-25.
"Mezzanine High Speed High-Density Connectors Gig-Array and Meg-Array Electrical Performance Data", FCI Corporation, 10 pages.
"MILLIPACS Connector, Type A Specification", Dec. 14, 2004, 1 page.
Nadolny et al., "Optimizing Connector Selection for Gigabit Signal Speeds", http:--www.ecnmag.com-article-CA45245, ECN, Sep. 1, 2000, 6 pages.
"NSP Series, Backplane High-Speed Data Transmission Cable Connectors", http:--www.honda-connectors.co.jp, Honda Connectors, 2006, 6 pages, English Translation attached.
"Overview: Backplane Products", http:--www.molex.com-cgi-bin-bv-molex-super_family-super_family.jsp?BV_SessionID=@, Molex, 2008, 1-3.
"PCB-Mounted Receptacle Assemblies, 2.00 mm (0.079 In) Centerlines, Right-Angle Solder-to-Board Signal Receptacle", Metrel, Berg Electronics, 2 pages.
"Perspective View of Gigarray IMLA", 1998, 1 page.
"VHDM Connector", http://www.teradyne.com/prods/tcs/products/connectors/backplane/vhdm/index.html, Amphenol TCS (ATCS), Jan. 31, 2006, 2 pages.
"VHDM Daughterboard Connectors Feature Press-Fit Terminations and a Non-Stubbing Separable Interface", Teradyne, Inc. Connections Sys Div, Oct. 8, 1997, 46 pages.
"VHDM High-Speed Differential (VHDM HSD)", http://www.teradyne.com/prods/bps/vhdm/hsd.html, Teradyne, Jan. 24, 2000, 6 pages.
"VHDM L-Series Connector", http://www.teradyne.com/prods/tcs/products/connectors/backplane/vhdm_1-series/index.html, Amphenol TCS(ATCS), 2006, 4 pages.
"Z-Dok and Connector", http://2dok.tyco.electronics.com, Tyco Electronics, May 23, 2003, 1-15.

* cited by examiner

ELECTRICAL CONNECTOR HAVING IMPEDANCE TUNING RIBS

CROSS-REFERENCE TO RELATED APPLICATIONS

This application claims the benefit of U.S. Provisional Patent Application Ser. No. 61/291,136 filed Dec. 30, 2009, the disclosure of which is hereby incorporated by reference as if set forth in its entirety herein.

BACKGROUND

A mezzanine electrical connector with edge coupled differential signal pairs is described in U.S. patent application Ser. No. 12/197,434, filed Aug. 25, 2008, the disclosure of which is hereby incorporated by reference in its entirety herein. A right-angle connector with single-ended or edge coupled differential signal pairs is described in U.S. Pat. No. 7,442,054, the disclosure of which is hereby incorporated by reference in its entirety herein.

When an electrical connector is designed or actually made, electrical characteristics of the electrical connector (skew, differential or single-ended impedance, crosstalk, etc.) and the physical characteristics of the electrical connector (mating interface dimensions, mounting footprint dimensions, card pitch, etc.) become fixed variables.

SUMMARY

In one embodiment, the present disclosure seeks to modify a pre-existing electrical characteristic (differential impedance, skew, crosstalk, etc.) of a commercially available, known, or pre-existing electrical connector without changing the form factor (shape, size, height, card pitch, depth, width, mating interface, mounting footprint, or any two or more of these physical characteristics) of the commercially available, known, or existing electrical connector.

According to another embodiment, a rib made of plastic, conductive lossy material, non-conductive lossy material, or other suitable material can be added along one or more electrical contacts of a pre-existing electrical connector. The rib changes an electrical characteristic of the pre-existing electrical connector, like impedance or skew, without changing mating interface dimensions or mounting interface dimensions of the pre-existing electrical connector. At high data transmission speeds, differential impedance mating and skew correction can also improve unwanted crosstalk and insertion loss values.

In accordance with one embodiment, an electrical connector includes a connector housing that supports a plurality of electrical contacts that each define a mating end and an opposed mounting end. The electrical contacts are arranged in a plurality of columns that each extend along a column direction, the columns spaced apart along a row direction, such that electrical contacts adjacent each other along a row direction define a space therebetween. The electrical connector further includes at least one rib disposed in the space and extending substantially parallel to the adjacent electrical contacts, such that the at least one rib and air are disposed in the space. The at least one rib is made from a material having a dielectric constant greater than air.

For example, the rib can be used to convert a pre-existing 100±10 Ohm differential mezzanine electrical connector into an 85±10 Ohm differential electrical connector without changing mating interface dimensions or mounting footprint dimensions of the pre-existing 100±10 Ohm differential mezzanine electrical connector. The rib can be used to convert a pre-existing 100±10 Ohm differential broadside right angle electrical connector into an 85±10 Ohm differential broadside right angle electrical connector without changing mating interface dimensions or a mounting footprint dimensions of the pre-existing 100±10 Ohm differential broadside right angle electrical connector. The rib can also be used to reduce skew in a pre-existing or designed 100±10 Ohm differential edge coupled right angle electrical connector without significantly reducing differential impedance in the pre-existing or designed 100±10 Ohm differential edge coupled electrical connector, without changing mating interface dimensions, and without changing mounting footprint dimensions of the pre-existing or designed 100±10 Ohm differential edge coupled electrical connector.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION

In accordance with one embodiment, an electrical connector includes a plurality of electrical contacts and a plurality of ribs that are disposed adjacent respective ones of the plurality of electrical contacts. The rib preferably has a dielectric constant greater than air such that the impedance or skew of the electrical connector is reduced with respect to a substantially identical electrical connector that does not include ribs disposed between adjacent electrical contacts.

Figure 1:
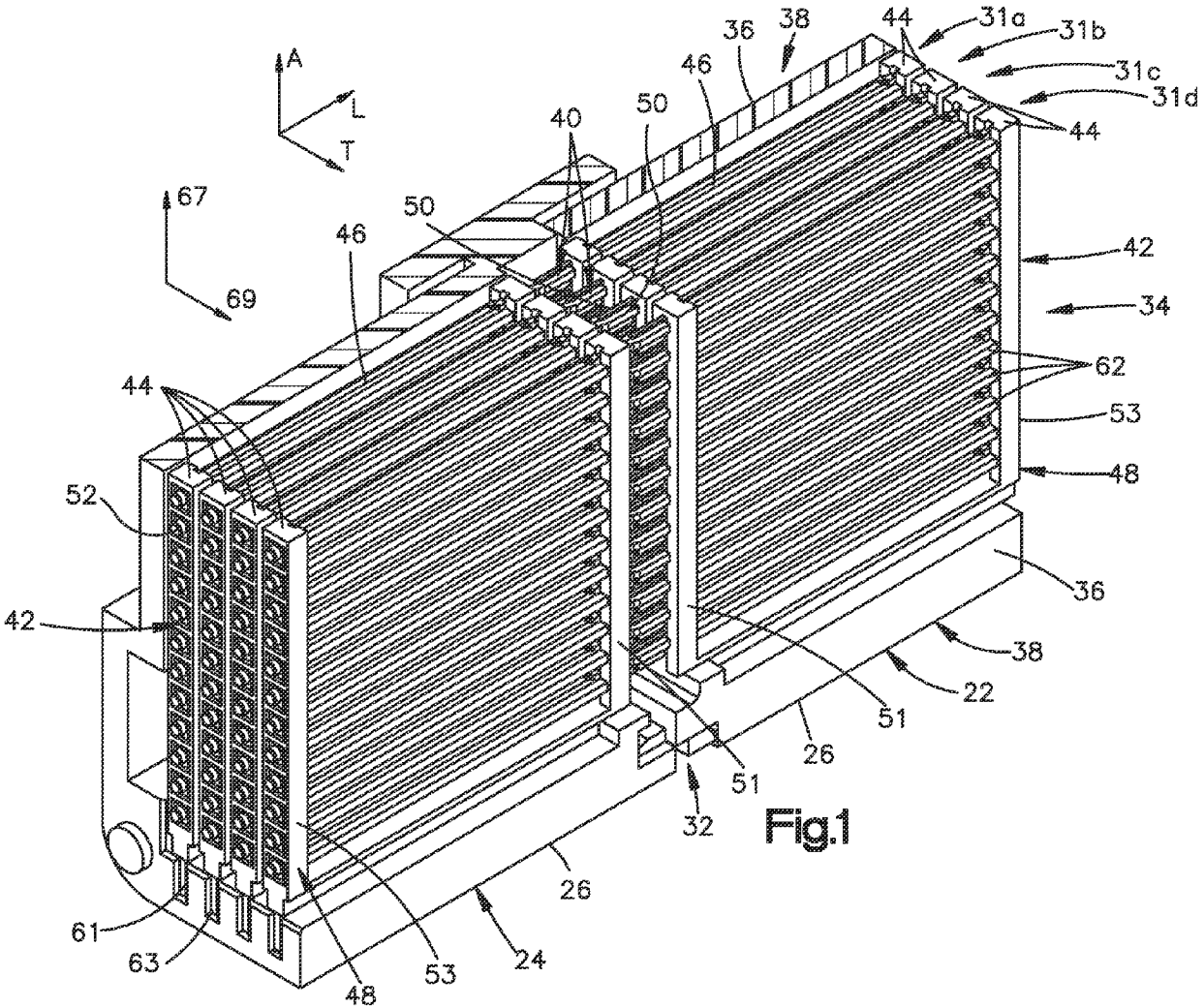
FIG. 1 is a perspective view of an electrical connector system including a first electrical connector and a similarly constructed second electrical connector mated with the first electrical connector, wherein a portion of the connector housing is removed.
Figure 2:
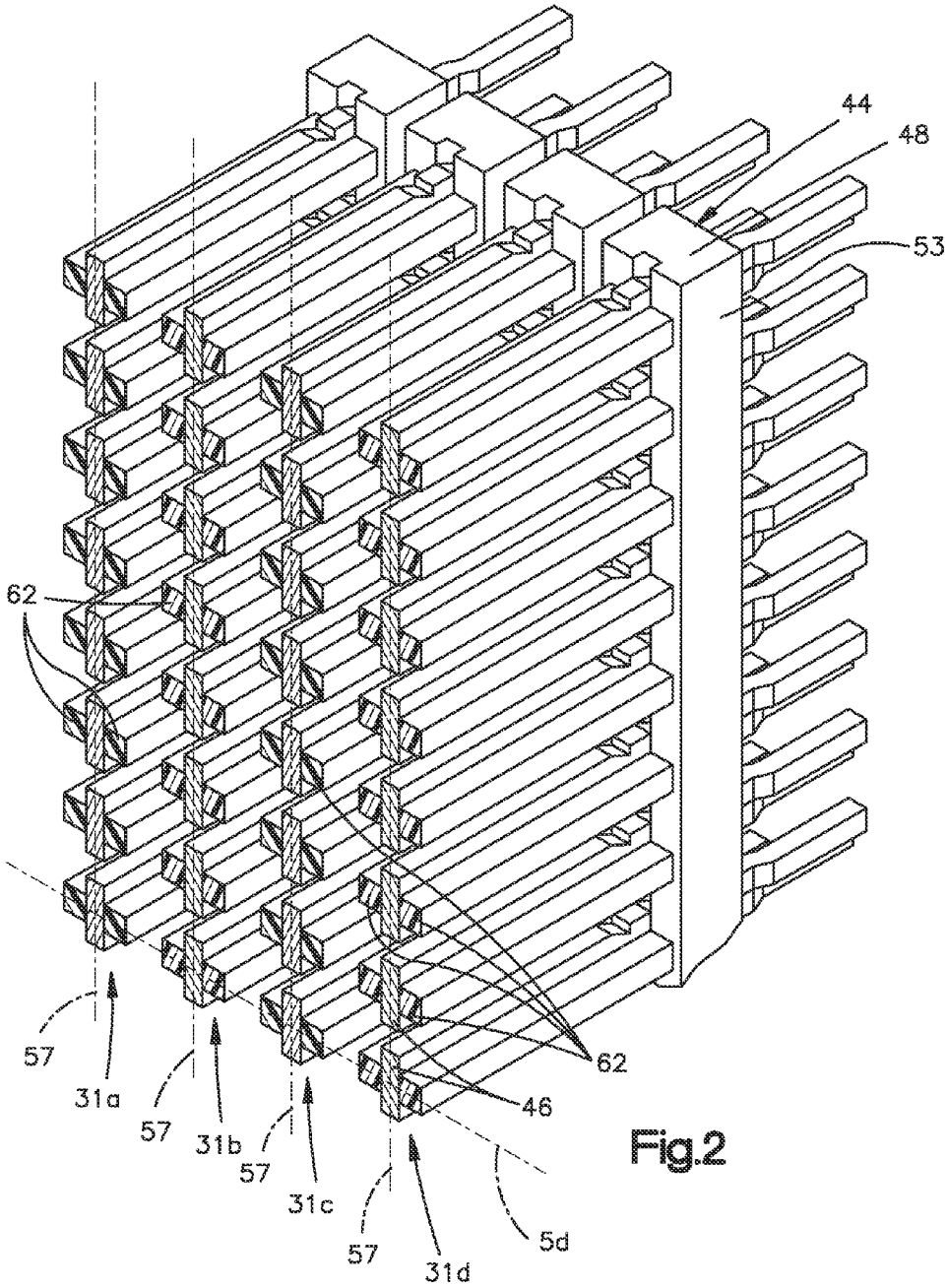
FIG. 2 is an enlarged perspective view of a portion of one of the electrical connectors illustrated in FIG. 1.
Figure 4:
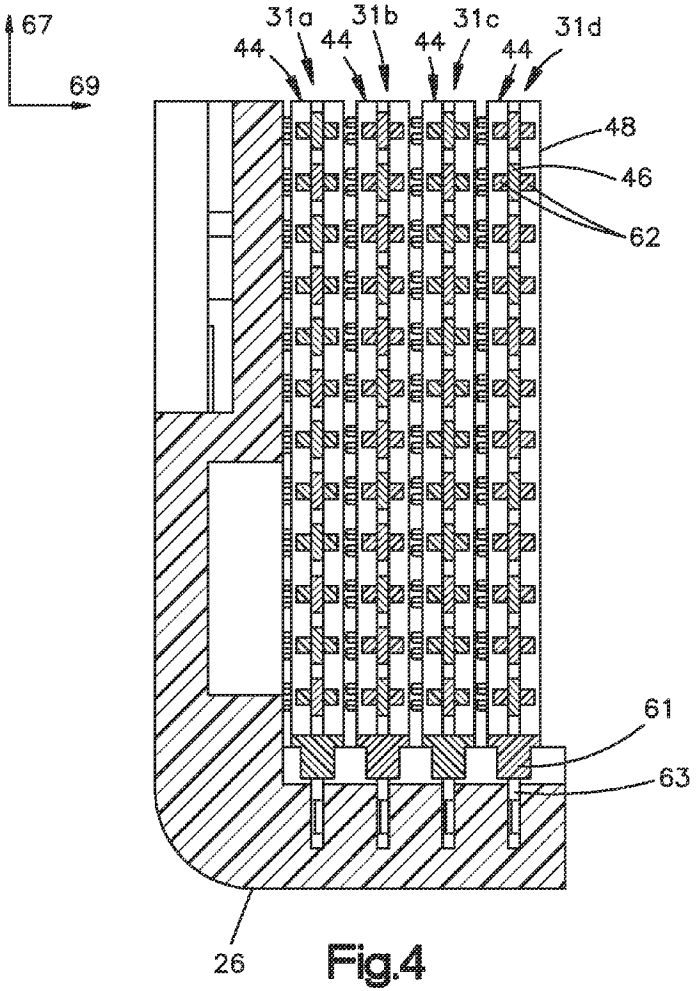
FIG. 4 is a sectional top plan view of a portion of a plurality of leadframe assemblies of the electrical connector illustrated in FIG. 2.

Referring to FIG. 1, an electrical connector assembly 20 includes a first electrical connector 22 configured to be electrically connected to a first substrate which can be provided as a printed circuit board, and a second electrical connector 24 configured to be electrically connected to a second substrate such as a printed circuit board. The first and second electrical connectors 22 and 24 are configured to mate with each other so as to place the first and second substrates in electrical communication with each other. Unless otherwise indicated, the first and second electrical connectors 22 and 24 of the electrical connector assembly 20 can be constructed as described in U.S. patent application Ser. No. 12/197,434, filed Aug. 25, 2008, the disclosure of which is hereby incorporated by reference in its entirety herein.

Accordingly, the second electrical connector can be constructed substantially identically with respect to the first electrical connector 22. Thus, the second electrical connector 24 can be constructed as described below with respect to the first electrical connector unless otherwise indicated below. The first electrical connector includes a connector housing 26 that supports a plurality of electrical contacts 46. The connector housing is dielectric or electrically insulative, and defines a front end 32, an opposed rear end 34, a first pair of opposed sides 36, and a second pair of opposed sides 38. The front and rear ends 32 and 34 are spaced apart along a longitudinal direction L, each of the first pair of opposed sides 36 are spaced apart along a lateral direction A that is substantially perpendicular with respect to the longitudinal direction L, and each of the second pair of opposed sides 38 are spaced apart along a transverse direction T that is substantially perpendicular with respect to both the longitudinal direction L and the lateral direction A. In accordance with the illustrated embodiment, the transverse direction T is oriented vertically, and the longitudinal and lateral directions L and A are oriented horizontally, though it should be appreciated that the orientation of the first electrical connector 22 may vary during use. In accordance with the illustrated embodiment, the first electrical connector 22 is illustrated as elongate in the longitudinal direction L.

The first electrical connector 22 further includes a plurality of electrical contacts 46 that are electrically conductive and supported by the connector housing 26. The first electrical connector 22 defines a mating interface 40 disposed proximate to the front end 32, and a mounting interface 42 disposed proximate to the rear end 34. The mating interface 40 is configured to operatively engage the mating interface 40 of the second electrical connector 24 when the first electrical connector 22 is mated with the second electrical connector 24, and the mounting interface 42 is configured to be placed in electrical communication with the underlying first substrate when the first electrical connector 22 is mounted to the underlying first substrate. The mounting interface 44 is configured to be placed in electrical communication with the underlying second substrate when the mounted to the underlying second substrate.

Figure 5:
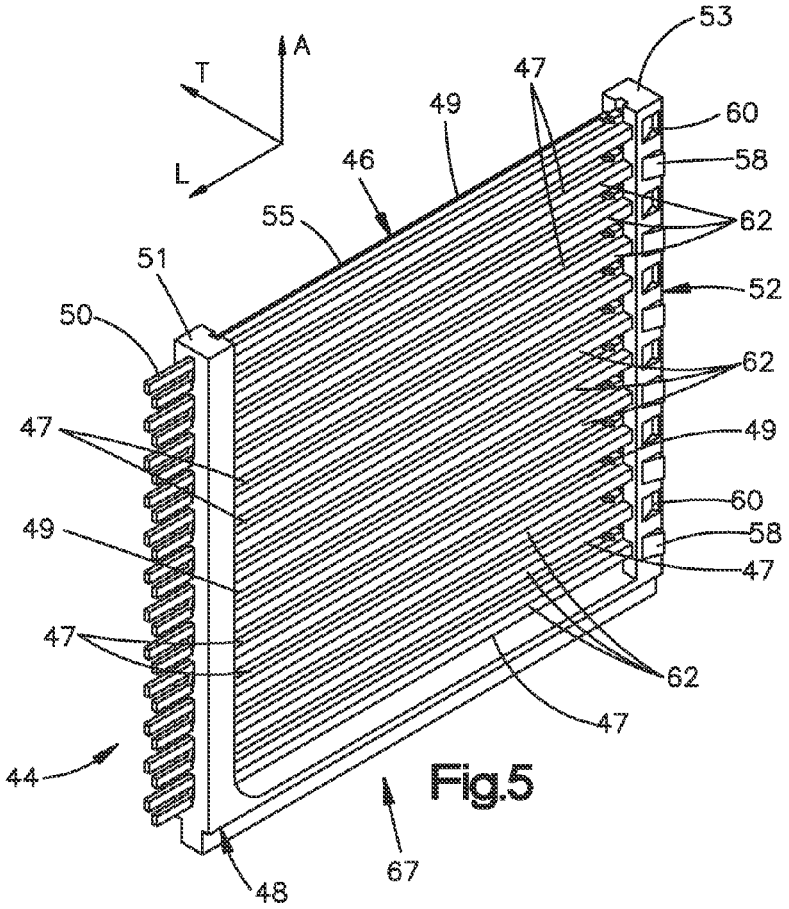
FIG. 5 is a perspective view of one of the leadframe assemblies illustrated in FIG. 4.

Referring also to FIG. 5, each of the electrical contacts 46 defines a mating end 50 disposed proximate to the mating interface 40, an opposed mounting end 52 disposed proximate to the mounting interface 42, and a body portion 55 that extends between the mating end 50 and the mounting end 52. The mating ends 50 of the electrical contacts 46 extend out or forward from the connector housing 26 and are configured to mate, or electrically connect, with complementary mating ends of the electrical contacts of the second electrical connector 24 when the first and second electrical connectors 22 and 24 are mated. The mounting ends 52 extend out or rearward from the connector housing 26, and are configured to electrically connect with complementary electrical traces in the underlying substrate when the first electrical connector 22 is mounted to the underlying substrate. Accordingly, the electrical contacts 46 place the underlying substrate in electrical communication with the electrical contacts of the second electrical connector 24 when the first electrical connector 22 is mated with the second electrical connector 24 and mounted to the underlying substrate.

The mating ends 50 of the electrical contacts 46 can be hermaphroditic, and forked or split as illustrated, or otherwise configured as desired. Alternatively, the mating ends 50 of the first electrical connector 22 can be provided as receptacles that are configured to receive complementary header mating ends 50 of the electrical contacts 46 of the second electrical connector 24, or can alternatively be provided as header mating ends configured to be received in complementary receptacle mating ends of electrical contacts of the second electrical connector 24. The mounting ends 52 can be configured to be surface mounted (e.g., soldered) onto electrical pads of the underlying substrate, can be configured to be press-fit mounted into complementary apertures of the underlying substrate, or otherwise electrically connected to electrical traces of the underlying substrate as desired.

In accordance with the illustrated embodiment, the mating interface 40 of the first electrical connector 22 is oriented substantially parallel with respect to the mounting interface 42, and the mating ends 50 of the electrical contacts 46 are substantially parallel with respect to the mounting ends 52. Thus, the first electrical connector 22 can be referred to as a mezzanine or vertical connector, and the electrical contacts 46 can be referred to as mezzanine or vertical contacts. It should be appreciated, of course that the first electrical connector 22 can alternatively be configured as a right-angle electrical connector (as shown in FIGS. 11-15), whereby the mating interface 40 is oriented substantially perpendicular with respect to the mounting interface 42. Likewise, the electrical contacts 46 can alternatively be configured as right-angle electrical contacts, whereby the mating ends 50 are oriented substantially perpendicular with respect to the mounting ends 52.

The first electrical connector 22 further includes a plurality of leadframe assemblies 44 that each, in turn, includes a respective insulative leadframe housing 48. The leadframe housing 48 of each leadframe assembly 44 can be made from a dielectric or electrically insulative material, and supports select ones of the plurality of the electrical contacts 46 that are stitched or otherwise supported by the respective leadframe housing 48. Alternatively, the leadframe assemblies 44 can be in the form of insert molded leadframe assemblies (IMLAs) whereby the leadframe housings 48 are overmolded onto the respective electrical contacts 46.

In accordance with the illustrated embodiment, each of the leadframe housings 48 defines at least one frame such as a first or front frame 51 and an opposed second or rear frame 53 spaced from the front frame 48 along the longitudinal direction L. The frames 51 and 53 each surround and support the electrical contacts 46 of the leadframe assembly 44, such that the body portions 55 extend between the frames 51 and 53. The first and second frames 51 and 53 can be spaced apart and disjoined from each other, or can alternatively be integral with each other or otherwise connected by leadframe housing material. The front and rear frames 51 and 53 are overmolded onto the electrical contacts 46. It should be appreciated that the leadframe housings 46 can define any suitable alternative size and shape as desired, and can further include one or more frames that can be integral with each other or spaced apart. The frames 51 and 53 can be made from any suitable dielectric material such as plastic, for instance a liquid crystal polymer (LCP).

The first or upper frame 51 is disposed proximate to the mating interface 40 of the first electrical connector 22 relative to the second or lower frame 53, and the second or lower frame 53 is disposed proximate to the mounting interface 42 of the first electrical connector 22 relative to the first or upper frame 51. Thus, the mating ends 50 of the respective electrical contacts 48 project longitudinally out from the first frame 51, and the mounting ends 52 of the respective electrical contacts 48 project longitudinally out from the second frame 53. Each leadframe assembly 44 can include projections 58 extending form one or both of the frames 51 and 53, such as the lower frame 53 as illustrated, and complementary recesses 60 disposed adjacent the projections 58 and configured to receive the projections 58 of adjacent leadframe assemblies 44. In accordance with the illustrated embodiments, the leadframe assemblies 44 include the projections 58 and recesses 60 alternatingly arranged and carried on both opposed sides of the lower frame 53. Thus, the adjacent leadframe assemblies 44 can be connected such that the projections 58 of each leadframe assembly 44 are received in the respective recesses 60 of the adjacent leadframe assemblies so as to couple the leadframe assemblies 44 to each other in the connector housing 26. The lower frame 53 can include outwardly extending tabs 61 that fit in complementary recesses 63 of the connector housing 26 so as to secure the leadframe assemblies 44 in the connector housing 26.

The electrical contacts 46 of each leadframe assembly 44 are spaced apart along a column direction 67 that extends laterally between the first pair of opposed sides 36. The electrical connector 22 can define a column pitch, which is a distance between centerlines of adjacent electrical contacts 46 along the column direction 67, of approximately 0.6 mm to approximately 1.5 mm, such as approximately 1 mm, or any suitable alternative distance. The leadframe assemblies 44 are spaced from each other along a row direction 69 that extends transversely between the second pair of opposed sides 38. In accordance with the illustrated embodiment, the first electrical connector 22 includes four leadframe assemblies 44, though it should be appreciated that the first electrical connector can include as many leadframe assemblies 44 as desired. As illustrated, the four leadframe assemblies are supported by the connector housing 26 in respective transversely spaced rows 31A-D. The electrical connector 22 can define a row pitch, which is a distance between centerlines of adjacent electrical contacts 46 along the row direction 69, of approximately 1 mm to approximately 2 mm, such as approximately 1.3 mm, or any suitable alternative distance. Each leadframe assembly 44 retains twelve electrical contacts 46 spaced along the column direction 67 as illustrated, though it should be appreciated that each leadframe assembly 44 can include any number of electrical contacts 48 greater or less than twelve as desired, such as twenty, or more or less than twenty.

In accordance with the illustrated embodiment, the electrical contacts 46 of each leadframe assembly 44 can include at least one signal contact 47 such as a plurality of signal contacts 47, and at least one ground contact 49 such as a plurality of ground contacts 49 that can be arranged as desired along the column direction. In accordance with the illustrated embodiment, adjacent pairs of signal contacts 47 along the column direction can define differential signal pairs. Alternatively, the signal contacts 47 can be single-ended. The ground contacts 49 can be disposed adjacent a signal contact 47, and can be disposed between adjacent signal contacts 47. For instance, the ground contacts 49 can be disposed between adjacent pairs of signal contacts 47, such as between adjacent differential signal pairs. Accordingly, a given ground contact 49 can be disposed between a first pair of adjacent signal contacts 47 and a second pair of adjacent signal contacts 47.

The plurality of electrical contacts 46 can be arranged in any configuration within the associated leadframe assembly 44, and can define an open field such that the electrical contacts 46 can be assigned ground contacts or signal contacts as desired. In accordance with one embodiment, the electrical contacts 46 can be assigned signal contacts and ground contacts so as to define a repeating signal-signal-ground (S-S-G) pattern along the column direction in the respective leadframe assemblies 44. The contact pattern of a given leadframe assembly 44 can be offset with respect to the contact pattern of an adjacent leadframe assembly 44. For instance, the leadframe assemblies 44 can include a first plurality of leadframe assemblies that define a repeating S-S-G-S-S-G pattern along the column direction from one of the first pair of opposed sides 36 to the other of the pair of opposed sides 36, and a second plurality of leadframe assemblies 44 that define a repeating G-S-S-G-S-S pattern along the column direction from the same one of the first pair of opposed sides 36 to the other of the pair of opposed sides 36 as the first plurality of leadframe assemblies 44. The first and second pluralities of leadframe assemblies can be alternatingly arranged along the row direction. It should be appreciated that the electrical contacts 48 of each leadframe assembly 44 can be provided in any pattern as desired, and the electrical contact patterns of adjacent leadframe assemblies 44 can be offset or aligned with each other as desired.

During operation, the electrical connectors 22 and 26 are configured to be mated to each other such that the mating interfaces 40 of the first electrical connector 22 mates with the mating interface 40 of the second electrical connector 24, thereby placing the electrical contacts 46 of the electrical connectors 24 and 24 in electrical communication with each other. When the first and second electrical connectors 22 and 24 are mounted to an underlying substrate, such as a printed circuit board, the respective mounting ends 52 of the electrical contacts 46 electrically connect to electrical traces of the first substrate so as to place the electrical contacts 46 of each electrical connector 22 and 24 in electrical communication with the respective substrate and each other, thereby placing the substrates in electrical communication with each other.

Referring now to FIGS. 1-6, each of the electrical contacts 46 can define respective first and second opposed broadsides 54 and first and second edges 56 connected between the broadsides along a length that is less than that of the broadsides 56, such that the electrical contacts 46 define a substantially rectangular cross section. In accordance with the illustrated embodiment, the broadsides 54 extend laterally, or along a direction substantially parallel to the column direction 67. Thus, the edges 56 of adjacent electrical contacts 46 can face each other along the respective column 39. The electrical contacts 46 can each define a first central axis 57 that extends along the column direction, or substantially parallel to the opposed broadsides 54 at a location substantially midway between the opposed broadsides 54, and a second central axis 59 that extends along the row direction 69, or substantially parallel to the opposed edges 56 at a location substantially midway between the opposed edges 56.

Accordingly, when the adjacent signal contacts 47 define respective differential pairs, the adjacent signal contacts 47 can be referred to as edge-coupled signal contacts. In accordance with the illustrated embodiment, the electrical contacts 46 are oriented so as to be edge coupled along the column direction 67. Thus, the broadsides 54 of each of the plurality of electrical contacts 46 faces the respective broadsides 54 of electrical contacts 46 of the adjacent leadframe assembly 44 that are aligned along the row direction 69. The electrical contacts 46 of the transversely outermost leadframe assemblies 44 define only one broadside 54 that faces the respective broadside 54 of the aligned electrical contacts 46 of the adjacent leadframe assemblies 44. Both opposed broadsides 55 of the leadframe assemblies 44 that are inwardly disposed with respect to the outermost leadframe assemblies 44 face respective broadsides 54 of aligned electrical contacts 46 of adjacent leadframe assemblies 44. Alternatively, it should be appreciated that the signal contacts 47 can be oriented such that the broadsides 54 of adjacent signal contacts 47 of a given differential pair face each other, such that the adjacent signal contacts 47 can alternatively be referred to as broadside-coupled signal contacts.

With continuing reference to FIGS. 2-6, at least one up to all of the leadframe assemblies 46 further includes at least one rib such as a plurality of ribs 62 that extend between, and are illustrated as connected between, the first and second frames 38 and 40. The ribs 62 can be longitudinally elongate along a substantial entirety of the electrical contacts 46, and in particular the broadsides 54 of the electrical contacts 46, between the first and second frames 51 and 53, for instance adjacent to the contact bodies 55. Thus, the ribs 62 extend substantially parallel with respect to the electrical contacts 46 along the longitudinal direction defined between the mating ends 50 and the mounting ends 52, even though the ribs 62 may not extend to the mating ends 50 and the mounting ends 52. Thus, the ribs 62 can extend along a portion or a majority of the length of the electrical contacts 46. Furthermore, the ribs 62 can extend substantially linearly in accordance with the illustrated embodiment, though it should be appreciated that the ribs 62 can define any suitable shape, and can be bent or curved, for instance, if the electrical contacts 46 are right-angle contacts. In accordance with the illustrated embodiment, the ribs 62 are connected between the first and second frames 51 and 53 as illustrated, the ribs 62 can alternatively extend between the frames 51 and 53, such that the ribs 62 extend from only one of the frames 51 and 53 toward the other frame but terminate at a location spaced from the opposed frame. Thus, the ribs 62 can extend along a part or the entire portion of respective ones of the plurality of electrical contacts 46 that extend between the frames 51 and 53.

At least one of the ribs 62 can extend along at least one of the opposed broadsides 54 of at least a select electrical contact 46 of the plurality of electrical contacts 46 up to all of the plurality of electrical contacts 46. For example, each of the electrical contacts 46 may include a first rib 62*a* (FIG. 3) on one of the opposed broadsides 46 and a second rib 62*b* on the other one of the opposed broadsides 46. Two adjacent ones 46A, 46B of the plurality of electrical contacts 46 may define an edge coupled differential signal pair.

Whether the ribs 62 actually touch the respective broadsides 54, or are slightly spaced apart from the broadsides, the ribs 62 can nevertheless be described as extending along the broadside. Accordingly, the at least one rib 62 is disposed between the select electrical contact 46 and an adjacent electrical contact 46 along the row direction. The ribs 62 are disposed adjacent both opposed broadsides 54 of the electrical contacts 46, and extend along the respective broadsides 54. Furthermore, in accordance with the illustrated embodiment, the ribs 62 extend out from the broadsides 54 of the electrical contacts 46 toward an adjacent electrical contact 46 along the row direction 69.

Figure 6:
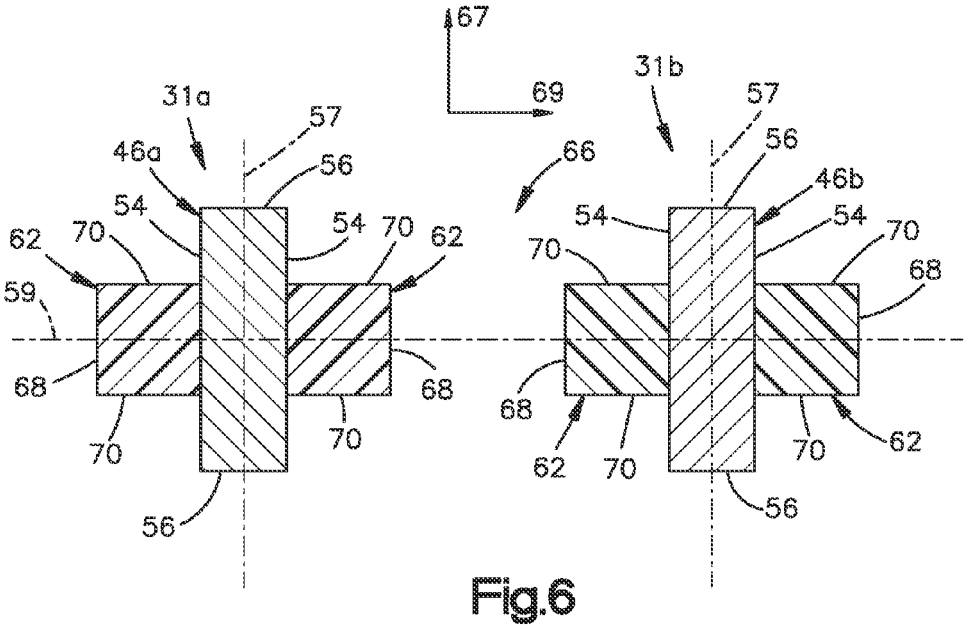
FIG. 6 is a sectional end view of the electrical connector illustrated in FIG. 2, showing a pair of electrical contacts of a respective pair of leadframe assemblies spaced apart along a row direction, the electrical connector including a pair of ribs extending along opposed sides of the electrical contacts.
Figure 8:
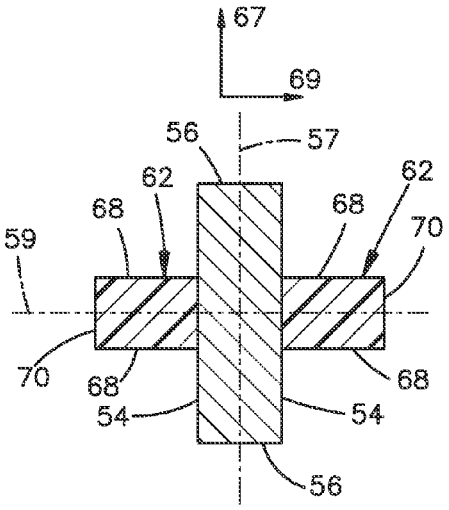
FIG. 8 is a top plan view of a portion of the electrical contacts similar to FIG. 7, showing a pair of ribs constructed in accordance with an alternative embodiment.
Figure 9:
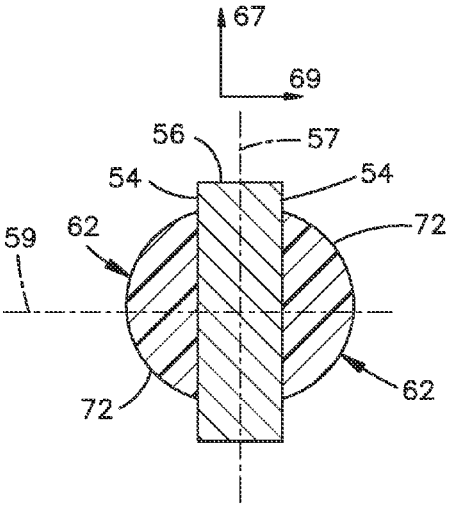
FIG. 9 is a top plan view of a portion of the electrical contacts similar to FIG. 7, showing a pair of curved ribs constructed in accordance with an alternative embodiment.

The ribs 62 can define any suitable shape as desired, such as the shape of any polygon, regular or irregular, as desired. For instance, as illustrated in FIG. 6, the ribs 62 can be substantially rectangular in shape having longer sides 68 that extend substantially parallel to the respective adjacent broadside 54 and substantially perpendicular to the respective edges 56, and shorter sides 70 that extend substantially parallel to the respective edges 56 and substantially perpendicular to the respective broadside 54. Alternatively, referring to FIG. 8, the longer sides 68 can extend substantially perpendicular to the respective adjacent broadside 54 and substantially parallel to the respective edges 56, and the shorter sides 70 can extend substantially perpendicular to the respective edges 56 and substantially parallel to the respective broadside 54. Alternatively still, as illustrated in FIG. 9, the ribs 62 can be round and define a curved outer surface 72 that can define an arc or any alternative suitable curved surface. The ribs 62 can thus define a rectangular or square cross-section, or any alternative geometric cross section as desired, including but not limited to triangular or other polygonal cross sections, or rounded cross sections such as circular cross sections and oval cross sections.

The ribs 62 can be overmolded onto the plurality of electrical contacts 36 along with the first and second frames 38 and 40, or the ribs 62 can be discretely connected to the first and second frames 38 and 40, and/or the plurality of electrical contacts 36. The ribs 62 can be made from a dielectric material such as plastic, for instance liquid crystal polymer. Thus, in accordance with the illustrated embodiment, the ribs 62 are made from the same material as the first and second frames 51 and 53. The ribs 62 can be integral with the first and second frames 51 and 53, or can be discreetly connected to the first and second frames 51 and 53 as desired. In this regard, the ribs 62 can be made from the same or a different material than the frames 51 and 53. The ribs 62 are made from a material having a dielectric constant greater than air, and accordingly reduce the impedance of a similarly constructed connector having only air disposed between the broadsides of the plurality of electrical contacts 36. For instance, air has a dielectric constant of approximately 1.0, while liquid crystal polymer has a dielectric constant of approximately 3.8.

Referring again to FIG. 6, the first electrical connector 22 defines a space 66 disposed between adjacent electrical contacts 46 along the row direction 69, and in particular disposed between the respective broadsides 54 of the adjacent electrical contacts 46 that face each other along the row direction, and extending between the opposed edges 56 of the adjacent electrical contacts 46. The space 66 can, for instance, be an air pocket, and the ribs 62 can extend from the respective broadsides 54 of the adjacent electrical contacts 46 into the space 66. In accordance with the illustrated embodiment, the space 66 includes both air along with the ribs 62. For instance, the first electrical connector 22 includes a first rib 62 that is disposed adjacent the broadside 54 of a first electrical contact 46*a*, and second rib 62 that is disposed adjacent the broadside 54 of a second electrical contact 46*b* that is disposed adjacent the first electrical contact 46 along the row direction, such that a pair of ribs 62 is disposed in the space 66. Alternatively, the ribs 62 can extend along only one of the opposed broadsides 54 of the electrical contacts 46, such that only one rib 62 is disposed in the space 66. It can thus be said that the first electrical connector 22 includes at least one rib 62 that is disposed adjacent, or extends along or out from, a respective broadside 54 of at least one up to all of the electrical contacts 46.

In accordance with the illustrated embodiment, the rib 62 disposed in the space 66 adjacent the first electrical contact 46*a* and the rib 62 disposed in the space 66 adjacent the broadside 54 of the second electrical contact 46*b* do not touch each other, such that both air and the ribs 62 are disposed in the space 66. Alternatively, if only one rib 62 is disposed in the space, the rib 62 can be configured so as to not touch the adjacent electrical contact along the row direction. Alternatively or additionally, the space 66 can include air along with the at least one rib 62 because the at least one rib 62 extends along only a portion of the broadside 54 along the column direction. Otherwise stated, the broadside 54 is longer along the column direction than the respective adjacent rib 62.

Alternatively, the at least one rib 62 can touch the opposed rib 62 and can extend substantially along the entire length of the broadside 54 along the column direction, and the ribs 62 can be shaped so as to define an air space between the first and second electrical contacts 46*a* and 46*b*. For instance, the ribs 62 can be round as illustrated in FIG. 9, such that the ribs 62 can abut each other or the broadside 54 of the adjacent electrical contact 46 such that the space 66 includes the rib as well as air.

It is recognized that as the ribs 62 define a volume in the space 66, such that as the volume of the ribs 62 increases in the space 66 relative to the volume of air disposed in the space 66, the overall dielectric constant in the space 66 increases, thereby decreasing the impedance of the first electrical connector 22 with respect to a conventional electrical connector having only air disposed in the space 66. It should be appreciated that the dielectric constant of the space 66 is greater than air. The volume of the ribs 62 disposed in the space 66 can be adjusted to thereby adjust the dielectric constant of the space 66, such that the dielectric constant of the space 66 is greater than a substantially identical space 66 that is filled only with air. It is further appreciated that as the volume of the space 66 occupied by the at least one rib 62 or ribs 62 increases relative to the air in the space 66, the impedance of the first electrical connector 22 decreases. For instance, one or both of the lateral width and the transverse depth of each of the ribs 62 can be increased so as to increase the overall dielectric constant of the space 66, thereby reducing the impedance of the first electrical connector 22. One or both of the lateral width and transverse depth of each of the ribs 62 can be decreased so as to decrease the overall dielectric constant of the space 66, thereby increasing the impedance of the first electrical connector 22. Thus, the electrical connector 22 includes a first material, such as air, disposed in the space 66 and a second material, such as plastic, for instance liquid crystal polymer, disposed in the space that has a dielectric constant greater than the first material. It should be appreciated that the first and second materials can be selected as desired. For instance, the rib 62 disposed adjacent one of the broadsides 54 in the space 66 can be made from a plastic having a first dielectric constant, and the rib 62 dispose adjacent the opposed broadside 54 in the space 66 can be made from a different plastic having a different dielectric constant than the first dielectric constant.

Accordingly, a method of tuning the impedance of the first electrical connector 22 can include the steps of placing a first material, such as at least one rib 62, having a dielectric constant greater than that of a second material, such as air, disposed in the space 66. The impedance of the first electrical connector 22 can be increased by providing reduced volumes of the first material in the space, and can be decreased by providing increased volumes of the first material in the space. For instance, as the cross-sectional area of the ribs 62 is increased, the impedance of the electrical connector decreases. As the cross-sectional area of the ribs is decreased, the impedance of the electrical connector increases. It should be appreciated that a desired impedance level can be achieved without increasing the distance between the adjacent rows 31, and thus without increasing the stack height of the first electrical connector 22 with respect to conventional electrical connectors. It has been found that when the space 66 is fully occupied by rib material, the impedance of the first electrical connector is approximately 76 ohms. As described above, when the space 66 is fully occupied by air, the impedance of the first electrical connector 22 is approximately 100±10 ohms. By adjusting the volume of the at least one rib 62 disposed in the space 66, the impedance of the first electrical connector 22 can be tuned between approximately 76 ohms and approximately 90 ohms. In accordance with one embodiment, the impedance of the first electrical connector 22 can be approximately 85 ohms.

Thus, a kit can include a plurality of electrical connectors 22 having leadframe assemblies 44, such that one of the electrical connectors 22 has ribs 62 of a first size and the ribs 62 of a second one of the electrical connectors 22 has a different size such that the impedance of the electrical connectors 22 are different. Furthermore, a kit can include a plurality of leadframe assemblies 44 having different sized ribs 62 that extend along the broadsides 54 of the respective electrical contacts 46 such that one of the leadframe assemblies 44 of the kit is associated with a different impedance level than another leadframe assembly 44 of the kit.

In accordance with the illustrated embodiment, a rib 62 extends along the broadside 54 of each signal contact 47 of the plurality of electrical contacts 46, thereby allowing for flexibility in the positioning of each leadframe assembly 44 as a transversely inner or outer leadframe assembly. As a result, the leadframe assemblies 44 can be substantially identically constructed, and thus configured so as to not be dedicated outer or inner leadframe assemblies, but can rather be positioned anywhere in the connector housing 26 along the transverse direction T. The ribs 62 can further extend along at least one or both of the opposed broadsides 54 of each of the plurality of electrical contact 46 so as to ensure that ribs 62 will extend along the broadsides of the signal contacts regardless of the pattern of signal and ground contacts in which the plurality of electrical contacts 46 are ultimately arranged.

Figure 7:
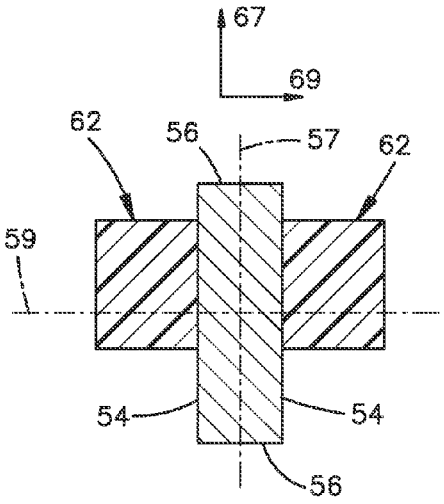
FIG. 7 is a sectional end view showing of the electrical contacts similar to FIG. 6, and a pair of offset ribs in accordance with an alternative embodiment.

Referring now to FIGS. 6 and 8-10, it should be appreciated that at least one rib 62 up to all of the ribs 62 can be positioned relative to the broadsides 54 of the respective electrical contacts 46 at a location substantially centered on the second central axis 57 that is located substantially midway between the opposed edges 56. Alternatively, as illustrated in FIG. 7, the at least one rib 62 up to all of the ribs 62 can be laterally offset with respect to the second central axis 57, and thus disposed at a location closer to one of the edges 56 of the respective electrical contacts 46 than the opposed edge 56.

It should be further appreciated that the leadframe assemblies 44 have been described and illustrated in accordance with one embodiment, and the ribs can extend along the broadsides of signal contacts of the plurality of electrical contacts 36 that define edge coupled differential signal pairs retained by any suitable alternatively constructed leadframe assembly 44 as desired.

Figure 11:
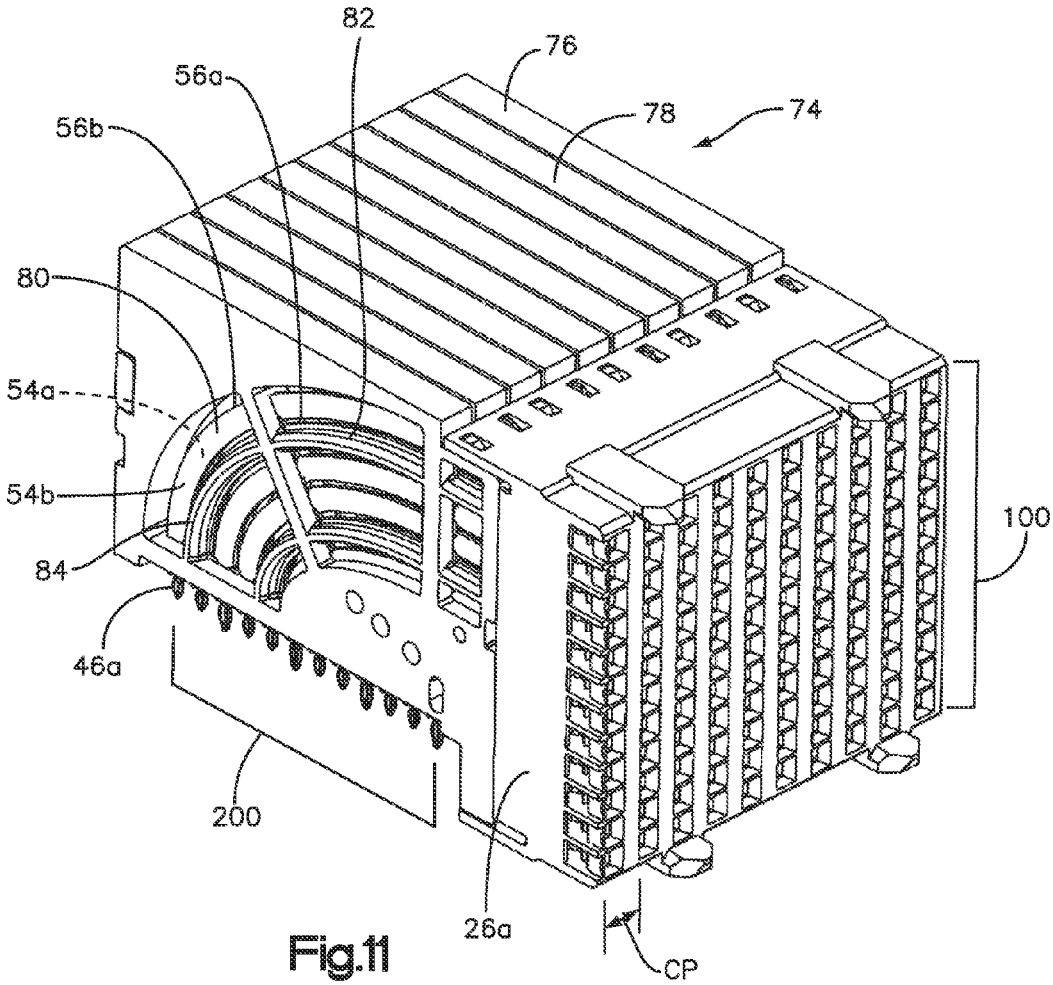
FIG. 11 is a perspective top view of a first electrical connector having a rib extending along at least one of the electrical contacts.

A right angle electrical connector 74 is shown in FIG. 11. The right angle connector 74 can include alternating first right angle leadframe assemblies 76 and second right angle leadframe assemblies 78. Alternatively, the right angle electrical connector 74 may include identical right angle leadframe assemblies 76 or 78, which can be provided as IMLAs as described above.

The right angle electrical connector 74 is shown as right angle receptacle connector, but right angle electrical connector 74 may also be a right angle header connector. The first and second right angle leadframe assemblies 76, 78 carry a plurality of electrical contacts 46*a*. At least one of the plurality of electrical contacts 46*a* defines at least one broadside 54*a*, a second broadside 54*b* opposite the at least one broadside 54*a*, and two opposed edges 56*a* and 56*b* that are shorter than the broadsides 54*a* and 54*b* as described above. The right angle electrical connector 74 also defines a mating interface 100 and a mounting interface 200 that is oriented substantially perpendicular to the mating interface 100.

Figure 12:
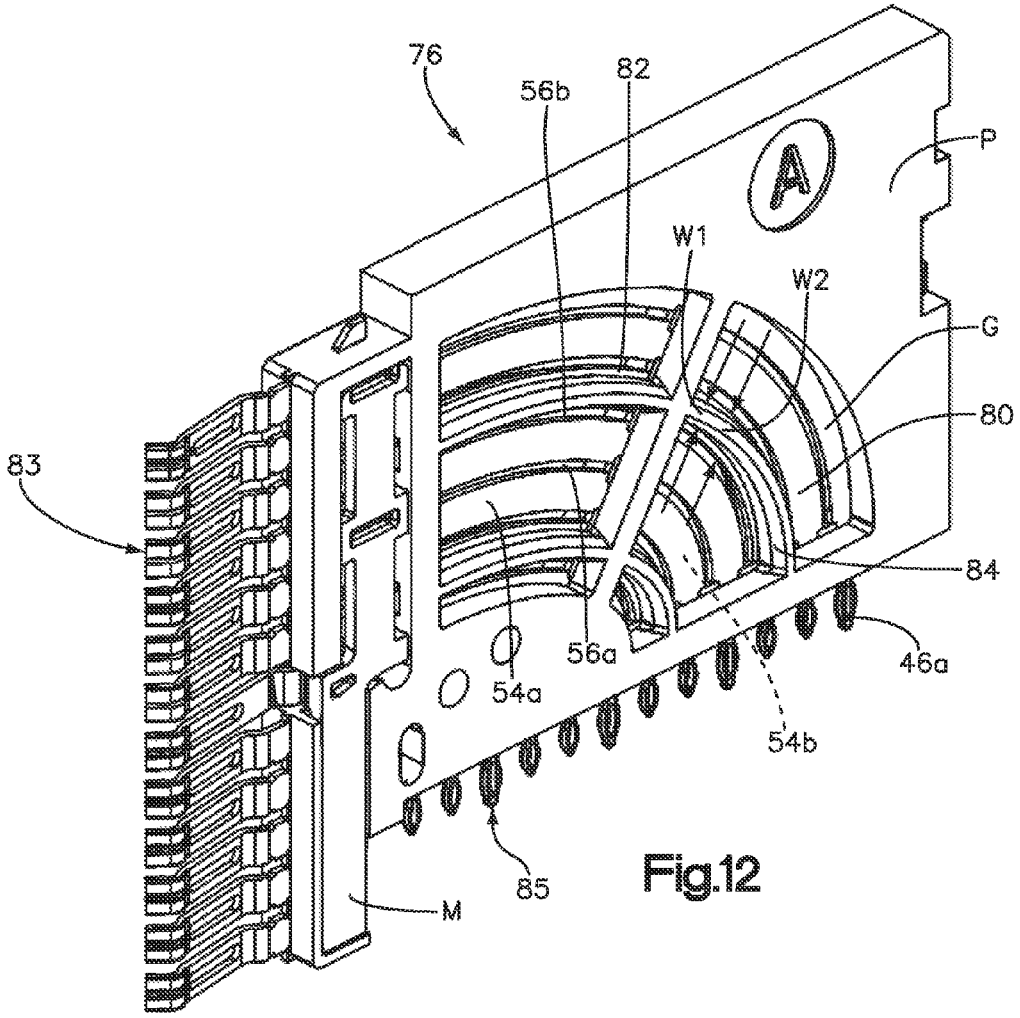
FIG. 12 is a perspective view of a first right angle leadframe assembly.
Figure 13:
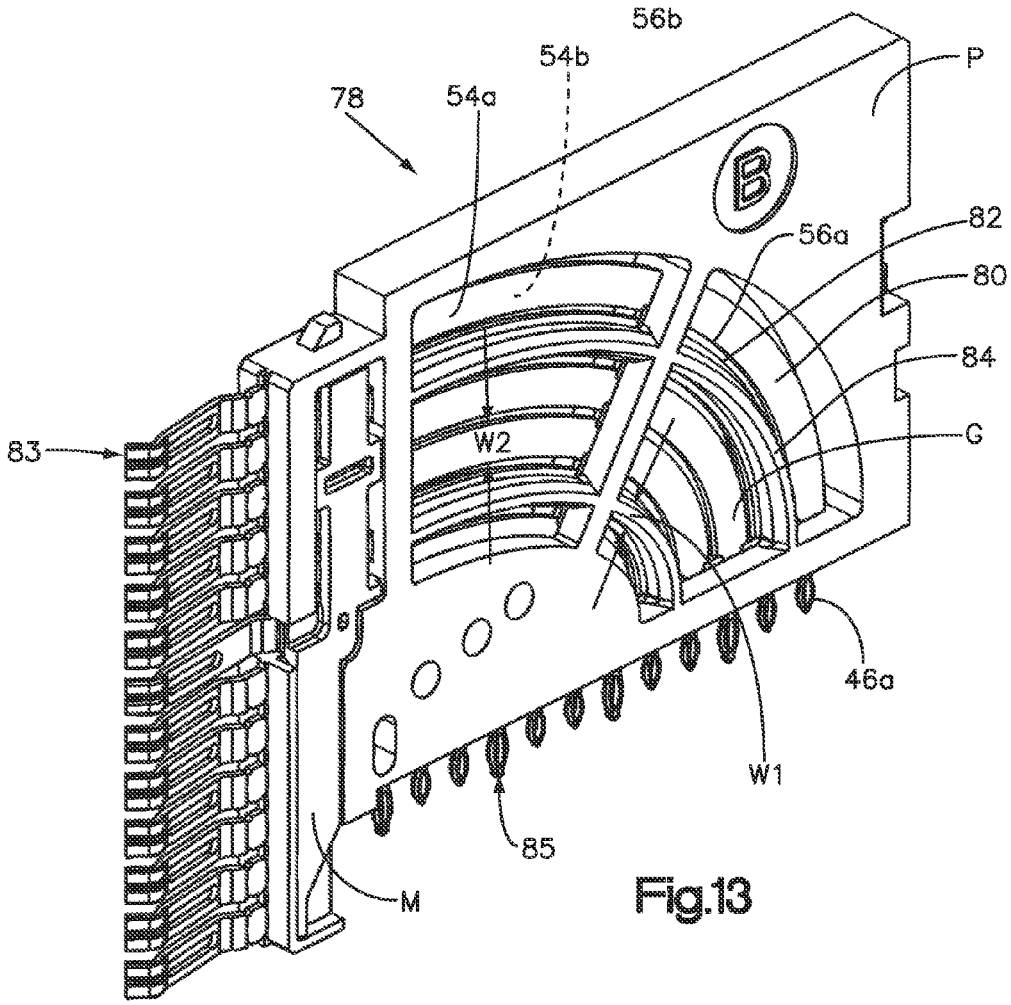
FIG. 13 is a perspective view of a second right angle leadframe assembly.
Figure 14:
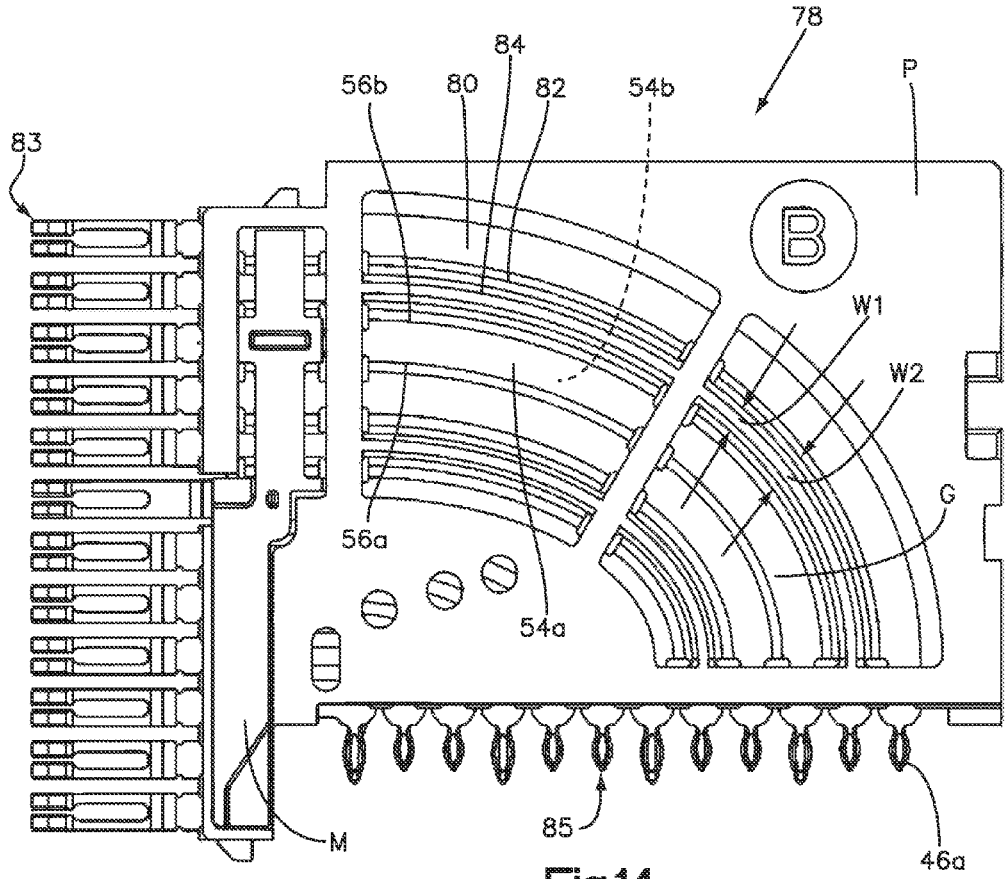
FIG. 14 is a side view of the second right angle leadframe assembly shown in FIG. 13.
Figure 15:
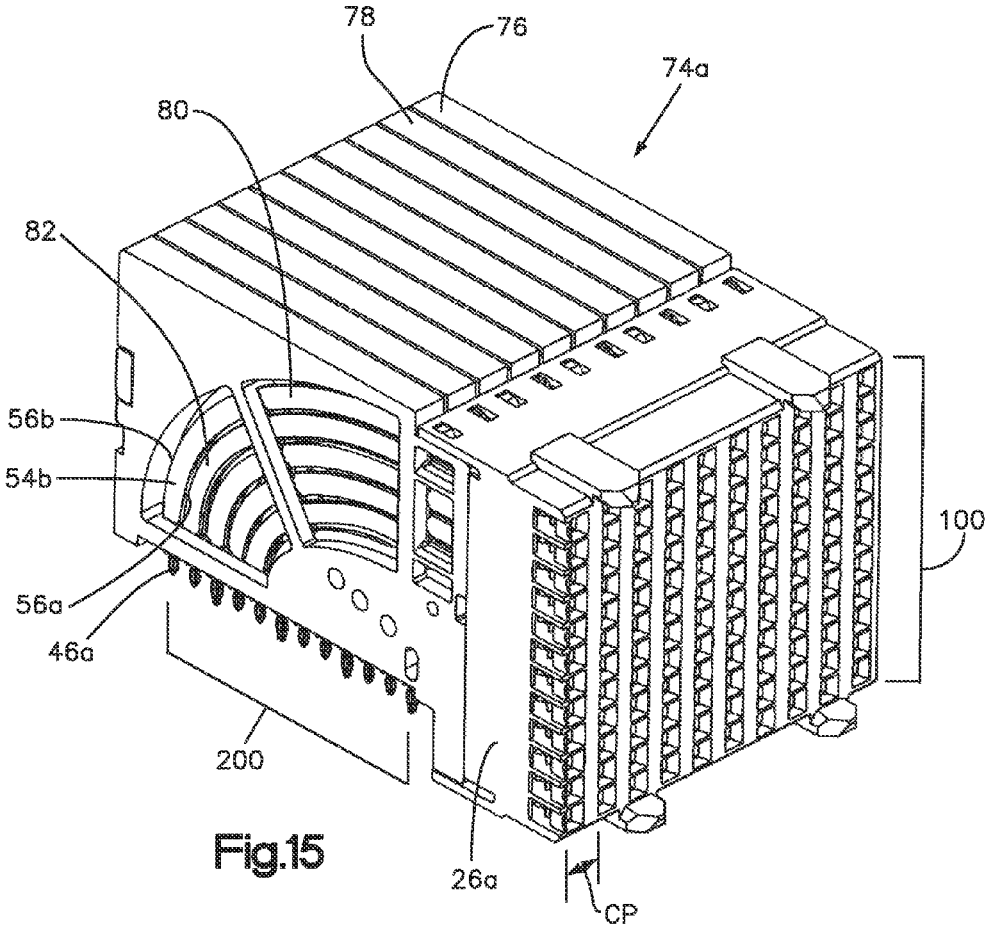
FIG. 15 is a perspective top view of a second electrical connector devoid of any ribs extending along the electrical contacts, but otherwise identical to the first electrical connector illustrated in FIG. 11.

A first right angle leadframe assembly 76 is shown in FIG. 12 and a second right angle leadframe assembly 78 is shown in FIGS. 13 and 14. The first right angle leadframe assembly 76, the second right angle leadframe assembly 78, or both may include electrically conductive or electrically non-conductive magnetic absorbing material M. The remainder of the first or second right angle leadframe assemblies 76, 78 may be made from electrically insulative plastic P or electrically non-conductive magnetic absorbing material M.

Two adjacent signal contacts 80 and 82 of the plurality of electrical contacts 46A may define a differential signal pair, such as an edge coupled differential signal pair. A ground contact G may be disposed adjacent to the edge coupled differential signal pair, and thus can be disposed between a pair of adjacent differential signal pairs. The signal contacts 80 and 82 define respective mating ends 83 and opposed mounting ends 85, and the signal contact 82 is physically shorter than the signal contact 80 along their respective lengths between the respective mating ends 83 and mounting ends 85. The leadframe assembly 76 can include a rib 84 that extends along at least a portion of the length (for instance fifty percent or more of the total length between the mating end 83 and mounting end 85) of the physically shorter signal contact 82. Accordingly, in this embodiment, without being bound by theory, it is believed that the rib 84 causes electrical signals to travel more slowly through the physically shorter signal contact 80 as opposed to the signal contact 82, thereby increasing the effective length of the physically shorter signal contact 82 between the mating end 83 and the opposed mounting end 85, and adjusting for inter-pair skew. The rib 84 may constructed from a dielectric plastic such as a liquid crystal polymer, electrically non-conductive magnet absorbing material, or other suitable material. In accordance with one embodiment, the rib 84 has a dielectric constant greater than that of air. The rib 84 may also be constructed from an electrically conductive magnetic absorbing material that is electrically insulated from other signal or ground contacts by insulative plastic P.

Figure 10:
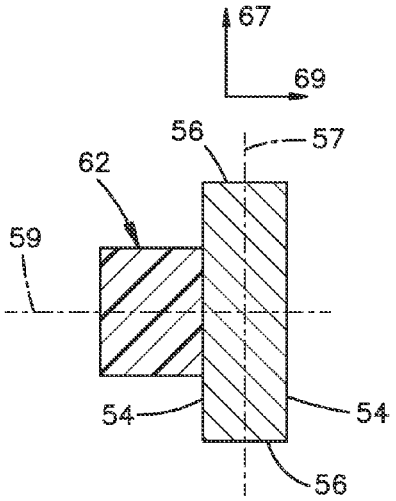
FIG. 10 is a top plan view of a portion of the electrical contacts similar to FIG. 7, showing a single rib constructed in accordance with an alternative embodiment.

Similar to FIG. 10, the rib 84 may be positioned adjacent to at least one broadside surface 54A, or both of the broadside surfaces 54A, 54B, of the physically shorter signal contact 82 of the two adjacent signal contact 80 and 82 of the plurality of electrical contacts 46*a*. The rib 84 may define a width W1 that is less than a width W2 of a broadside surface 54A or 54B of the physically shorter one 82 of the two adjacent ones 80, 82 of the plurality of electrical contacts 46A. Alternatively, similar to previous FIGS. 7-9, ribs 84 may also be positioned adjacent to two opposed broadsides 54*a*, 54*b* of one of the signal contacts 80 and 82 carried by an electrical connector 74 (FIG. 11). Regardless of the number of ribs 84, the rib or ribs 84 may each have a first width W1 that is less than, equal to, or greater than second width W2 of a broadside surface 54A, 54B of one of the plurality of electrical contacts 46A.

Adding the rib or ribs 84 to one broadside surface or both broadside surface 54*a* and 54*b* of just one of the electrical contacts 46A in a right angle differential signal pair can compensate for inter-pair skew. By adjusting the amount of plastic, other dielectric material, or electrically isolated electrically conductive magnetic absorbing material used for the rib 84, a balance can be struck between unwanted differential impedance loss or gain and desired skew correction. Ribs 84 can also be added to virtually any electrical contact of a select electrical connector that is otherwise substantially identical to any pre-existing or designed right angle electrical connector to improve skew without modifying a mating interface, a mounting interface or footprint, a height, a depth, or a width of the select electrical connector with respect to the pre-existing right angle electrical connector.

Figure 3:
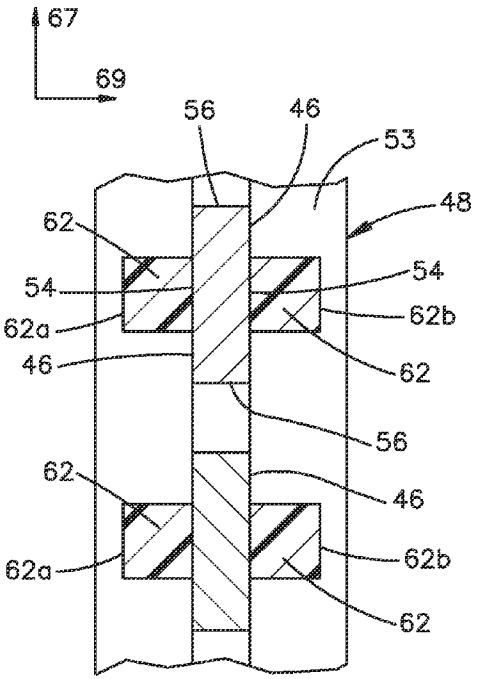
FIG. 3 is an enlarged top plan view of a portion of the electrical connector illustrated in FIG. 2.

Accordingly, a method is provided to change an electrical characteristic of a known (to anyone) or pre-existing (designed or made) electrical connector 74 as illustrated in FIG. 11. The method may include the step of modifying impedance or skew of the known electrical connector 74 without changing a mating interface 100 of the known electrical connector, a mounting interface 200 of the known electrical connector, or both. The step of modifying impedance or skew may include a step of adding a rib or dielectric rib, such as the rib 62 as illustrated in FIG. 3 or the rib 84 to at least one broadside surface, such as the broadside surfaces 54 illustrated in FIG. 3 or the broadside surfaces 54*a* and 54*b* of at least one electrical contact, such as the electrical contact 46 illustrated in FIG. 3 or the electrical contact 46*a*, which can be provided as a signal contact, carried by a select electrical that is substantially otherwise identical with respect to a known electrical connector, such as electrical connectors 22 and 24 illustrated in FIG. 1 or the electrical connector 74. Additional steps include limiting a width W1 of the rib or dielectric rib 62, 84 so that the rib 62, 84 does not extend beyond at least one of two opposed edges 56A, 56B of the broadside surface 54, 54A, 54B of the respective electrical contact 46, 46A.

With reference to FIG. 3, a second method to fabricate a select mezzanine electrical connector having a modified electrical characteristic with respect to an otherwise identically constructed pre-existing electrical connector may include the steps of adding a dielectric rib 62 to at least one broadside surface 54 of one electrical contact 46 of the select mezzanine electrical connector such that the select mezzanine electrical connector has a differential impedance of 85±10 Ohms, while the pre-existing electrical connector has a differential impedance of 100±10 Ohms. Thus, the select mezzanine electrical connector has a differential impedance less than that of the pre-existing electrical connector. Alternatively, with reference to FIGS. 11-14, the method may also include the step of adding the dielectric rib 84 to at least one of or both of broadside surfaces 54*a* and 54*b* of one electrical contact 46*a*, such as a signal contact, of a select right angle differential electrical connector 74 so as to reduce skew with respect to an otherwise identically constructed pre-existing right angle differential electrical connector.

Accordingly, a first or select electrical connector 74 (FIG. 11) can be identical with respect to a second pre-existing electrical connector 74*a* (FIG. 15), with the exception that the first or select electrical connector 74 includes a first skew, and the second pre-existing electrical connector 74*b* includes a second skew that is different than the first skew. For instance, because the first or select electrical connector 74 includes a rib 84 that extends at least fifty percent along a broadside surface 54*b* of at least one electrical contact 46*a*, for instance the shorter signal contact 82 of a differential pair of signal contacts 80 and 82, the first skew is less than the second skew. Both of the electrical connectors 74 and 74*a* have identical mating footprints 200, identical mating interfaces 100, and identical column pitch CP, but the first or select electrical connector 74 has a rib 84 extending along at least 50% of the length of at least one of the electrical contacts. It should be appreciated that the second electrical connector 74*b* can alternatively include a rib 84 as described above, but sized differentially than the rib 84 of the first electrical connector 74.

It should thus be appreciated that a method to provide a plurality of electrical connectors having different electrical characteristics includes the steps of fabricating a first electrical connector, such as the electrical connector 74*a*, that including a first housing, such as the housing 26*a*, that supports a first plurality of electrical contacts such as electrical contacts 46*a*, wherein the first electrical connector 74*a* defines a first mating interface 100 and an opposed first mounting interface 200. The method further includes the step of fabricating a second electrical connector, such as the electrical connector 74, including a second housing 26*a* that supports a second plurality of electrical contacts 46*a*, wherein the second electrical connector 73 defines a second mating interface 100 that is equal to the first mating interface 100 and an opposed second mounting interface 200 that is equal to the first mounting interface 200. The second electrical connector 74 includes a dielectric rib 84 that extends along at least one or both of the broadside surfaces 54*a* and 54*b* of at least the one of the second plurality of electrical contacts 46*a*, such that the second electrical connector 74 includes at least one of an impedance and a skew that is different than the first electrical connector.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. A leadframe assembly comprising:

a leadframe housing that supports a plurality of electrical contacts, each of the plurality of electrical contacts defining opposed broadside surfaces and opposed edges connected between the opposed broadside surfaces, each of the opposed edges each extending along a length between the opposed broadside surfaces, and each of the opposed broadside surfaces extending along a width between the opposed edges, such that the width is greater than the length, wherein one of the opposed edges of a first one of a pair of adjacent electrical contacts of the plurality of electrical contacts faces one of the opposed edges of a second one of the pair of adjacent electrical contacts;

a first rib extending along and abutting a first one of the opposed broadside surfaces of a select one of the first and second ones of the pair of adjacent electrical contacts; and a second rib, detached from the first rib, the second rib extending along and abutting a second one of the opposed broadside surfaces of the select one of the first and second ones of the pair of adjacent electrical contacts, wherein each of the first and second ribs has a dielectric constant greater than air.

2. The leadframe assembly as recited in claim 1, wherein each of the plurality of electrical contacts comprises a rib that extends along each one of the opposed broadside surfaces.

3. The leadframe assembly as recited in claim 1, wherein each of the first rib and the second rib does not extend beyond the opposed edges of the one of the plurality of electrical contacts.

4. The leadframe assembly as recited in claim 1, wherein the first and second ones of the pair of adjacent electrical contacts define an edge coupled differential signal pair.

5. The leadframe assembly as recited in claim 4, wherein the select one of the first and second ones of the pair of adjacent electrical contacts is physically shorter than the other one of the first and second ones of the pair of adjacent electrical contacts.

6. An electrical connector comprising:

a connector housing;

a plurality of electrical contacts supported by the connector housing, each of the plurality of electrical contacts defining a mating end and an opposed mounting end, the electrical contacts each define opposed broadside surfaces and opposed edges connected between the opposed broadside surfaces, each of the opposed edges extending along a length between the opposed broadside surfaces, and each of the opposed broadside surfaces extending along a width between the opposed edges, such that the width is greater than the length;

a first rib extending along and abutting a first broadside surface of a select one of the electrical contacts; and a second rib, detached from the first rib, the second rib extending along and abutting a second one of the opposed broadside surfaces of the select one of the electrical contacts, wherein each of the first and second ribs has a dielectric constant greater than air.

7. The electrical connector as recited in claim 6, wherein one of the opposed edges of the select one of the electrical contacts faces one of the opposed edges of an adjacent one of the electrical contacts along a column direction.

8. The electrical connector as recited in claim 6, wherein the select one of the electrical contacts defines a central axis that extends substantially parallel to the opposed edges at a location substantially midway between the opposed edges, and the at least one rib is substantially centered on the central axis.

9. The electrical connector as recited in claim 6, wherein the select one of the electrical contacts defines a central axis that extends substantially parallel to the opposed edges at a location substantially midway between the opposed edges, and the at least one rib is offset with respect to the central axis.

10. A method of tuning an electrical characteristic of an electrical connector that includes a connector housing supporting an array of electrical contacts with a space defined between first and second adjacent electrical signal contacts that define a differential signal pair in the array of electrical contacts, each of the electrical contacts defining opposed broadside surfaces and opposed edges connected between the opposed broadside surfaces, each of the opposed edges extending along a length between the opposed broadside surfaces, and each of the opposed broadside surfaces extending along a width between the opposed edges, such that the width is greater than the length, the method comprising the steps of:

selecting a volume of a rib to be disposed in the space adjacent a shorter one of the first and second adjacent electrical signal contacts;

placing a rib in the space such that the rib does not extend beyond the opposed edges of the shorter one of the first and second adjacent electrical contacts, such that the rib and air are disposed in the space, the rib made from a material having a dielectric constant greater than air so that the space, including the air and the rib, defines a dielectric constant greater than air.

11. A method to provide a plurality of electrical connectors having different electrical characteristics, the method comprising the steps of:

fabricating a first electrical connector including a first housing and a first plurality of electrical contacts supported by the first housing, the first plurality of electrical contacts including a first edge coupled differential signal pair, wherein the first electrical connector defines a first mating interface and an opposed first mounting interface; and fabricating a second electrical connector including a second housing and a second plurality of electrical contacts supported by the second housing, the second plurality of electrical contacts including a second edge coupled differential signal pair, wherein the second electrical connector defines a second mating interface that is identical to the first mating interface and an opposed second mounting interface that is identical to the first mounting interface, wherein the step of fabricating the first electrical connector comprises the step of placing a dielectric rib along a broadside surface of one electrical contact of the first edge coupled differential signal pair of the first electrical connector and not on the other electrical contact of the first edge coupled differential signal pair of the first electrical connector, the dielectric rib having a dielectric constant greater than air such that the dielectric rib causes the first edge coupled differential signal pair to have a skew that is less than the second edge coupled differential signal pair, and wherein the step of fabricating the first electrical connector further comprises the step of limiting a width of the dielectric rib so that the dielectric rib does not extend beyond either of two opposed edges of the one electrical contact.

12. The method as recited in claim 11, wherein the broadside surface of the one contact of the first edge coupled differential signal pair is a first of a pair of opposed broadside surfaces, and the two opposed edges are connected between the opposed broadside surfaces, each of the opposed edges each extending along a length between the opposed broadside surfaces, and each of the opposed broadside surfaces extending along a width between the opposed edges, such that the width is greater than the length.

13. The method as recited in claim 11, wherein the step of fabricating a first electrical connector further comprises the step of adding dielectric ribs to two opposed broadside surfaces of the one electrical contact carried by the first electrical connector.

14. Two similar electrical connectors comprising:

a first one of the two similar electrical connectors that comprises a first skew and a second one of the two similar electrical connectors that comprises a second skew that is less than the first skew, wherein both of the two similar electrical connectors have 1) identical mating footprints, 2) identical mating interfaces, 3) identical longer and shorter electrical contacts, each of the shorter and longer electrical contacts defining respective opposed broadside surfaces and respective opposed edges connected between the opposed broadside surfaces, each of the opposed edges each extending along a length between the opposed broadside surfaces, and each of the opposed broadside surfaces extending along a width between the opposed edges, such that the width is greater than the length, and 4) identical column pitch, but the second one of the two similar electrical connectors 1) has at least one skew-correction rib that extends fifty percent or more along a respective one of the opposed broadside surfaces of the shorter electrical contact between a mating end of the shorter electrical contact and the mounting end of the shorter electrical contact, and 2) is devoid of any one or more skew-correction ribs that extend along either of the broadside surfaces of the longer electrical contact, such that the at least one skew-correction rib extending along the respective one of the opposed broadside surfaces of the shorter electrical contact of the second one of the two similar electrical connectors causes electrical signals to travel more slowly through the shorter electrical contact of the second one of the two similar electrical connectors with respect to the shorter electrical contact of the first one of the two similar electrical connectors.

15. The leadframe assembly as recited in claim 1, further comprising third and fourth ribs that extend along each of the opposed broadside surfaces, respectively, of the other of the first and second ones of the pair of adjacent electrical contacts, each of the third and fourth ribs having a dielectric constant greater than air.

16. The leadframe assembly as recited in claim 1, wherein the first and second ones of the pair of adjacent electrical contacts are signal contacts.

17. The leadframe assembly as recited in claim 1, wherein the select one of the pair of adjacent electrical contacts defines a mating end and a mounting end, and a length that extends between the mating end and the mounting end, and the first and second ribs extend along a majority of the length.

18. The leadframe assembly as recited in claim 17, wherein the mating end and mounting end are oriented substantially perpendicular with respect to each other.

19. The electrical connector as recited in claim 7, further comprising a third rib that extends along one of the opposed broadsides of the adjacent one of the electrical contacts, the third rib having a dielectric constant greater than air.

20. The electrical connector as recited in claim 7, wherein the select one and the adjacent one of the electrical contacts are signal contacts.

21. The electrical connector as recited in claim 20, wherein select one and the adjacent one of the electrical contacts define an edge coupled differential signal pair.

22. The method as recited in claim 10, further comprising selecting a volume of the rib disposed in the space so as to correspondingly reduce a differential impedance of the electrical connector.

23. The method as recited in claim 11, wherein the dielectric rib causes the first electrical connector to have an impedance different than the second electrical connector.

24. The method as recited in claim 11, further comprising the step of selecting a volume of the dielectric rib so as to adjust an amount of the skew.

25. The electrical connector as recited in claim 6, wherein the select one of the electrical contacts defines a mating end and a mounting end, and a length that extends between the mating end and the mounting end, and the first and second ribs extend along a majority of the length.

26. The leadframe assembly as recited in claim 6, wherein each of the first rib and the second rib does not extend beyond the opposed edges of the one of the plurality of electrical contacts.

27. The method as recited in claim 10, wherein the first and second adjacent electrical signal contacts defines a mating end and a mounting end, and a length that extends between the mating end and the mounting end, and the rib extends along a majority of the length.

28. The method as recited in claim 10, wherein each of the electrical contacts defines opposed broadside surfaces and opposed edges connected between the opposed broadside surfaces, each of the opposed edges each extending along a length between the opposed broadside surfaces, and each of the opposed broadside surfaces extending along a width between the opposed edges, such that the width is greater than the length, and wherein the rib does not extend beyond the opposed edges of the electrical contacts.

29. The method as recited in claim 11, wherein the first plurality of electrical contacts defines a mating end and a mounting end, and a length that extends between the mating end and the mounting end, and the dielectric rib extends along a majority of the length.

30. The two similar electrical connectors as recited in claim 14, wherein the at least one skew-correction rib does not extend beyond the opposed edges of the shorter electrical contact.

31. The two similar electrical connectors as recited in claim 14, wherein the at least one skew-correction rib comprises a first skew-correction rib that extends fifty percent or more along one of the opposed broadside surfaces, and a second skew-correction rib that extends fifty percent or more along the other of the opposed broadside surfaces.

32. The two similar electrical connectors as recited in claim 31, wherein neither the first skew-correction rib nor the second skew-correction rib extends beyond the opposed edges of the shorter electrical contact.

33. The two similar electrical connectors as recited in claim 31, wherein each of the first and second skew-correction ribs has a dielectric constant greater than air.

34. The two similar electrical connectors as recited in claim 14, wherein the at least one skew-correction rib has a dielectric constant greater than air.

* * * * *